US006346804B2

(12) United States Patent
Ueno et al.

(10) Patent No.: US 6,346,804 B2
(45) Date of Patent: Feb. 12, 2002

(54) IMPEDANCE CONVERSION CIRCUIT

(75) Inventors: Takashi Ueno, Kawasaki; Tetsuro Itakura, Tokyo; Hiroshi Tanimoto, Kitami, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/885,979

(22) Filed: Jun. 22, 2001

(30) Foreign Application Priority Data

Jun. 23, 2000 (JP) ..... 2000-188858

(51) Int. Cl.[7] ..... G05F 3/16
(52) U.S. Cl. ..... 323/315; 323/280; 363/73
(58) Field of Search ..... 363/73; 323/312, 323/313, 314, 315, 316, 280, 281; 327/540, 541, 543

(56) References Cited

U.S. PATENT DOCUMENTS 4,334,198 A * 6/1982 Malchow ..... 323/315 X
4,618,814 A * 10/1986 Kato et al. ..... 323/280
5,982,201 A * 11/1999 Brokaw et al. ..... 323/312 X

OTHER PUBLICATIONS

J.O. Voorman, et al. "On Balanced Integrator Filters", Integrated Continuous–Time Filters, Paper 2–A.2, 1992, pp. 66–86 (no month).

R. Alini, et al. "8–32MHz Tunable BiCMOS Continuous–Time Filter", (Reprinted from Digest ESSCIRC '91, pp. 9–12, 1991), Paper 3–B.3, pp. 235–238 (no month).

S. Celma, et al., "CMOS pseudo–differential transconductor for VHF applications", Electronics Letters, vol. 35, No. 18, Sep. 2, 1999, pp. 1540–1542.

* cited by examiner

*Primary Examiner*—Jessica Han
(74) *Attorney, Agent, or Firm*—Oblon, Spivak, McClelland, Maier & Neustadt, P.C.

(57) ABSTRACT

There is disclosed an impedance conversion circuit called a regulated cascode circuit in which a parasitic capacity deteriorating frequency characteristics is reduced during operation up to about several hundreds of megahertz or higher frequencies. In the impedance conversion circuit comprising two regulated cascode circuits in which active elements and reverse amplifiers are interconnected with a feedback applied thereto, a capacity element is disposed between a control end of one active element and an output end of the other active element.

22 Claims, 10 Drawing Sheets

IMPEDANCE CONVERSION CIRCUIT

CROSS-REFERENCE TO RELATED APPLICATIONS

This application is based upon and claims the benefit of priority from the prior Japanese Patent Application No. 2000-188858, filed Jun. 23, 2000, the entire contents of which are incorporated herein by reference.

BACKGROUND OF THE INVENTION

1. Field of the Invention

The present invention relates to an impedance conversion circuit for use in an amplifier or the like constituted on an integrated circuit, and particularly to an improvement of frequency characteristics of an impedance conversion circuit.

2. Description of the Related Art

In recent years, the integration of semiconductors circuit built into an apparatus has been increasingly advanced. Above all, the signal processing portion, miniaturization and speed enhancement of an integrated circuit have been advanced and have resulted in digitization. However a circuit block in which analog processing is performed also exists on the grounds that it is difficult to develop digital processing. Examples of the circuit block in which analog signal processing is performed include a filter circuit which selects a desired signal in frequency domain.

The bandwidth of conventional active filters is of the order of several hundreds of kilohertz to several megahertz. On the other hand, the band required for broadband communication, hard disk lead channel, and the like is 100 times (about several hundreds of megahertz) the conventional band. Accordingly, the frequency characteristics of a transconductor (voltage-current converter) for use in the filter need to be strict. When the frequency characteristics of the transconductor for use in the filter deteriorate, the desired filter transmission characteristics cannot be realized, and normal reception cannot be performed. For example, to constitute a high-order filter, when the gain of an integrator using the transconductor becomes 1, and the phase deviates from −90 degrees, the frequency characteristics of the filter are influenced greatly.

While there are requests to broaden the band of the transconductor and amplifier constituting the filter, there are also requests for reducing current consumption.

A cascode connection has long been used in order to reduce a loss of the integrator and raise an output resistance of the transconductor, or to obtain the gain of the amplifier. The term, "cascode", means a "cascade" connection in which a "triode" ("tri" and "electrode") is included.

As a technique by which a higher output impedance can be secured, there is an impedance conversion circuit called a regulated cascode circuit (hereinafter referred to as RGC circuit) using an operational amplifier and feedback technique shown in FIGS. 23 and 24 as introduced by K. BULT et. al., Analog Integrated Circuits and Signal Processing Vol. 1, No. 2, pp. 119 to 135, 1991, and the like. The entire contents of this reference being incorporated herein by reference.

FIG. 23 shows a bipolar transistor (Q0, Q1) as an amplification element, and FIG. 24 shows a field-effect transistor (M0, M1) as the amplification element. In the cascode connection, an amplification circuit (Q0 or M0) is connected in series on a collector or drain side of an emitter or source of the transistor (Q1 or M1), wherein an input-voltage Vin is connected to the base of the Q0 or the gate of the M0. An operational-amplifier A1 is connected to the base of the Q1 or the gate of the M1. The emitter or the source of the transistor (Q1 or M1) is connected to the inverting input terminal of A1, thereby realizing a negative feedback circuit for regulation.

A signal output is extracted from a node (Iout) on the collector or drain side of the transistor (Q1 or M1), and a very large output impedance can be realized. That is, the output resistance of the transconductor can be raised. When the cascode connection is used in the amplifier, a high gain can be realized. Note that an arrow in FIG. 23 shows a direction of a current flow.

It is, however, unable to disregard a parasitic capacity (Cp) between the base and the emitter of the transistor Q1 or the gate and the source of the M1, when the transistors are used in the RGC circuit at a high frequency of several hundreds of megahertz or more.

Accordingly, there arises a problem that it is unable to obtain satisfactory frequency characteristics at higher frequencies in an application of the above described RGC circuits including the impedance conversion circuit for transconductor circuits.

BRIEF SUMMARY OF THE INVENTION

An object of the present invention is to provide an impedance conversion circuit in which satisfactory frequency characteristics can be maintained even at higher frequencies.

According to embodiments of the present invention, there is provided an impedance conversion circuit comprising, a first current input terminal to which a first signal current is input, a first transistor having a base, collector, and emitter, the emitter being connected to the first current input terminal, a first amplifier circuitry connected between the emitter and the base of the first transistor, a second current input terminal to which a second signal current having a phase opposite to a phase of the first signal current is input, a second transistor having a base, collector, and emitter, the emitter being connected to the second current input terminal, a second amplifier circuitry connected between the emitter and the base of the second transistor, a first capacitive element connected between the base of the first transistor and the emitter of the second transistor, and a second capacitive element connected between the base of the second transistor and the emitter of the first transistor.

According to embodiments of the present invention, there is provided a transconductor circuit comprising, a first voltage input terminal to which a first signal voltage is input, a first current source connected to the first voltage input terminal, configured to generate a first signal current in proportion to the first signal voltage, a first transistor having a base, collector, and emitter, the emitter being connected to the first current source, a first amplifier circuitry connected between the emitter and the base of the first transistor, a second voltage input terminal to which a second signal voltage having a negative phase of the first signal voltage is input, a second current source connected to the second voltage input terminal, configured to generate a second signal current in proportion to the second signal voltage, a second transistor having a base, collector, and emitter, the emitter being connected to the second current source, a second amplifier circuitry connected between the emitter and the base of the second transistor, a first capacitive element connected between the base of the first transistor and the emitter of the second transistor, and a second capacitive element connected between the base of the second transistor and the emitter of the first transistor.

According to embodiments of the present invention, there is provided an impedance conversion circuit comprising, a first current input terminal to which a first signal current is input, a first transistor having a gate, drain, and source, the source being connected to the first current input terminal, a first amplifier circuitry connected between the source and the gate of the first transistor, a second current input terminal to which a second signal current having a phase opposite to a phase of the first signal current is input, a second transistor having a gate, drain, and source, the source being connected to the second current input terminal, a second amplifier circuitry connected between the source and the gate of the second transistor, a first capacitive element connected between the gate of the first transistor and the source of the second transistor, and a second capacitive element connected between the gate of the second transistor and the source of the first transistor.

According to embodiments of the present invention, there is provided a transconductor circuit comprising, a first voltage input terminal to which a first signal voltage is input, a first current source connected to the first voltage input terminal, configured to generate a first signal current in proportion to the first signal voltage, a first transistor having a gate, drain, and source, the source being connected to the first current source, a first amplifier circuitry connected between the source and the gate of the first transistor, a second voltage input terminal to which a second signal voltage having a negative phase of the first signal voltage is input, a second current source connected to the second voltage input terminal, configured to generate a second signal current in proportion to the second signal voltage, a second transistor having a gate, drain, and source, the source being connected to the second current source, a first amplifier circuitry connected between the source and the gate of the second transistor, a first capacitive element connected between the gate of the first transistor and the source of the second transistor, and a second capacitive element connected between the gate of the second transistor and the source of the first transistor.

According to embodiments of the present invention, there is provided an impedance conversion circuit comprising, a first current input terminal to which a first signal current is input, a first transistor having a base, collector, and emitter, the emitter being connected to the first current input terminal, a first amplifier circuitry connected between the emitter and the base of the first transistor, a second current input terminal to which a second signal current having a phase opposite to a phase of the first signal current is input, a second transistor having a base, collector, and emitter, the emitter being connected to the second current input terminal, a second amplifier circuitry connected between the emitter and the base of the second transistor, a third capacitive element connected between the base of the first transistor and the collector of the second transistor, and a fourth capacitive element connected between the base of the second transistor and the collector of the first transistor.

According to embodiments of the present invention, there is provided an impedance conversion circuit comprising, a first current input terminal to which a first signal current is input, a first transistor having a gate, drain, and source, the source being connected to the first current input terminal, a first amplifier circuitry connected between the source and the gate of the first transistor, a second current input terminal to which a second signal current having a phase opposite to a phase of the first signal current is input, a second transistor having a gate, drain, and source, the source being connected to the second current input terminal, a second amplifier circuitry connected between the source and the gate of the second transistor, a third capacitive element connected between the gate of the first transistor and the drain of the second transistor, and a fourth capacitive element connected between the gate of the second transistor and the drain of the first transistor.

According to embodiments of the present invention, there is provided an impedance conversion circuit comprising, a first current input terminal to which a first signal current is input, a first transistor having a base, collector, and emitter, the emitter being connected to the first current input terminal, a first amplifier circuitry connected between the emitter and the base of the first transistor, a second current input terminal to which a second signal current having a phase opposite to a phase of the first signal current is input, a second transistor having a base, collector, and emitter, the emitter being connected to the second current input terminal, a second amplifier circuitry connected between the emitter and the base of the second transistor, a first capacitive element connected between the base of the first transistor and the emitter of the second transistor, a second capacitive element connected between the base of the second transistor and the emitter of the first transistor, a third capacitive element connected between the base of the first transistor and the collector of the second transistor, and a fourth capacitive element connected between the base of the second transistor and the collector of the first transistor.

According to embodiments of the present invention, there is provided an impedance conversion circuit comprising, a first current input terminal to which a first signal current is input, a first transistor having a gate, drain, and source, the source being connected to the first current input terminal, a first amplifier circuitry connected between the source and the gate of the first transistor, a second current input terminal to which a second signal current having a phase opposite to a phase of the first signal current is input, a second transistor having a gate, drain, and source, the source being connected to the second current input terminal, a second amplifier circuitry connected between the source and the gate of the second transistor, a first capacitive element connected between the gate of the first transistor and the source of the second transistor, a second capacitive element connected between the gate of the second transistor and the source of the first transistor, a third capacitive element connected between the gate of the first transistor and the drain of the second transistor, and a fourth capacitive element connected between the gate of the second transistor and the drain of the first transistor.

According to embodiments of the present invention, there is provided an impedance conversion circuit comprising a first active element, first inverting amplifier circuit whose input terminal is connected to an output end of the first active element, and whose output terminal is connected to a control end of the first active element, a second active element, a second inverting amplifier circuit whose input terminal is connected to an output end of the second active element, and whose output terminal is connected to a control end of the second active element, a first capacity element connected between the control end of the first active element and the output end of the second active element, and a second capacity element connected between the control end of the second active element and the output end of the first active element.

According to embodiments of the present invention, there is provided an impedance conversion circuit comprising, a first active element, a first inverting amplifier circuit whose input terminal is connected to a first output end of the first active element, and whose output terminal is connected to a control end of the first active element, a second active element, a second inverting amplifier circuit whose input terminal is connected to a first output end of the second active element, and whose output terminal is connected to a control end of the second active element, a third capacity element connected between the control end of the first active element and a second output end of the second active element, and a fourth capacity element connected between the control end of the second active element and a second output end of the first active element.

According to embodiments of the present invention, there is provided an impedance conversion circuit comprising, a first active element for controlling a current flowing between a first output end and a second output end in response to a signal applied to a control end, a first inverting amplifier circuit whose input terminal is connected to the first output end of the first active element, and whose output terminal is connected to the control end of the first active element, a second active element for controlling a current flowing between a first output end and a second output end in response to a signal applied to a control end, a second inverting amplifier circuit whose input terminal is connected to the first output end of the second active element, and whose output terminal is connected to the control end of the second active element, a first capacity element connected between the control end of the first active element and the first output end of the second active element, and a second capacity element connected between the control end of the second active element and the first output end of the first active element, wherein the second output end of the first active element is connected to a first current output terminal, the second output end of the second active element is connected to a second current output terminal, the first output end of the first active element is connected to a first current input terminal, the first output end of the second active element is connected to a second current input terminal, and polarities of the signals applied to the first current input terminal and the second current input terminal are reversed.

According to embodiments of the present invention, there is provided an impedance conversion circuit comprising, a first active element for controlling a current flowing between a first output end and a second output end in response to a signal applied to a control end, a first inverting amplifier circuit whose input terminal is connected to the first output end of the first active element, and whose output terminal is connected to the control end of the first active element, a second active element for controlling a current flowing between a first output end and a second output end in response to a signal applied to a control end, a second inverting amplifier circuit whose input terminal is connected to the first output end of the second active element, and whose output terminal is connected to the control end of the second active element, a third capacity element connected between the control end of the first active element and the second output end of the second active element, and a fourth capacity element connected between the control end of the second active element and the second output end of the first active element, wherein the second output end of the first active element is connected to a first current output terminal, the second output end of the second active element is connected to a second current output terminal, the first output end of the first active element is connected to a first current input terminal, the first output end of the second active element is connected to a second current input terminal, and polarities of the signals applied to the first current input terminal and the second current input terminal are reversed.

DETAILED DESCRIPTION OF THE INVENTION

Figure 1:
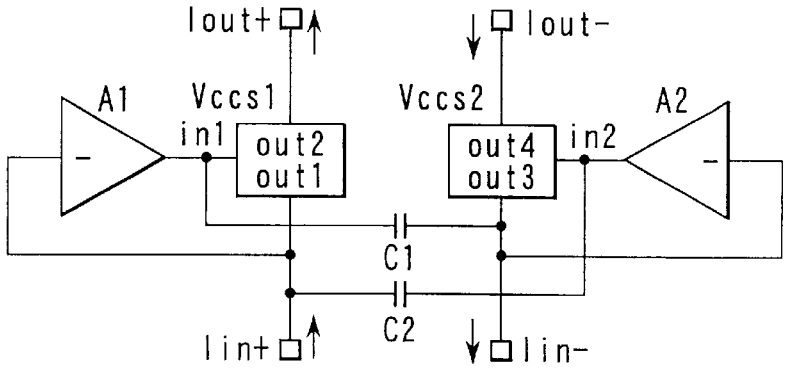
FIG. 1 is a circuit diagram of an impedance conversion circuit according to a first embodiment of the present invention.

Embodiments of the present invention will be described hereinafter with reference to the drawings. Additionally, in the circuit diagrams, where wirings (solid lines in the drawing) intersect one another with a black dot means that they are electrically connected. A portion in which the wirings intersect one another and no black circle is shown is not electrically connected.

(First Embodiment)

FIG. 1 is a circuit diagram of an impedance conversion circuit according to a first embodiment of the present invention. A silicon substrate is used as a circuit substrate. Signal currents flow to second output ends (out2, out4) of active elements (Vccs1, Vccs2) from first output ends (out1, out3) of first and second active elements (Vccs1, Vccs2) as amplification elements. Polarities of the signal currents flowing through these two active elements (Vccs1, Vccs2) are different from each other. That is, phases deviate from each other by π. Input terminals of inverting amplifier circuitry (A1, A2) having voltage gains are connected to the first output ends (out1, out3) of the active elements (Vccs1, Vccs2), respectively. The output terminals of the inverting amplifier circuitry (A1, A2) are connected to control ends (in1, in2) of the elements Vccs1, Vccs2, respectively. The aforementioned connections constitute feedback loops in Vccs1 and A1, and Vccs2 and A2. Voltages of the first output ends (out1, out3) of the active elements (Vccs1, Vccs2) are hardly influenced by fluctuations of signal currents inputted via first and second input terminals (Iin+, Iin−) of the impedance conversion circuit of FIG. 1. A substantially constant voltage can be maintained. This keeps operating voltages of nodes of the first output ends (out1, out3) of the active elements (Vccs1, Vccs2) stable, and realizes large linear-range operation in impedance conversion circuit. Note here that the signal currents inputted via the first and second input terminals (Iin+, Iin−) are different from each other in polarity, but substantially the same in size.

Figure 2:
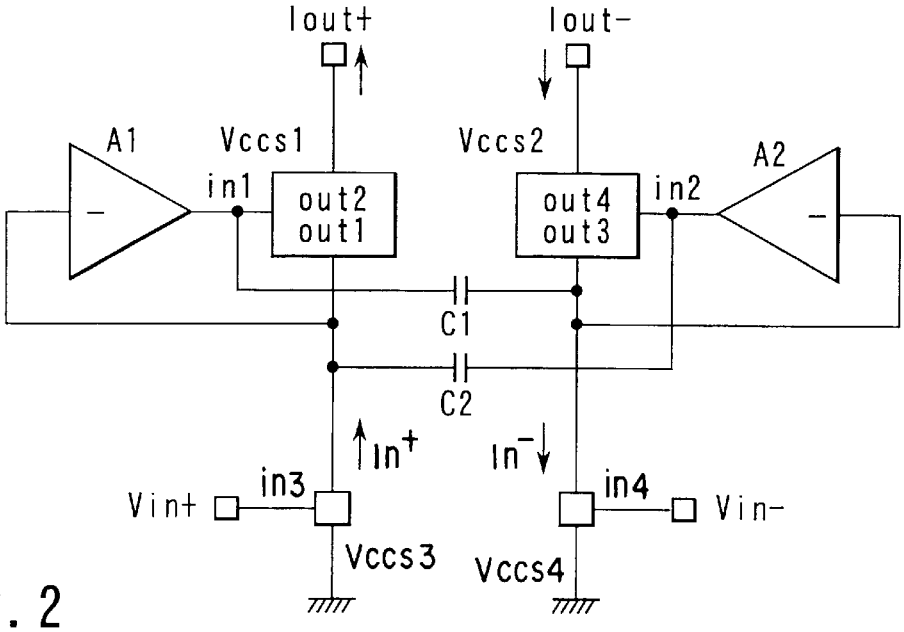
FIG. 2 is a circuit diagram of a transconductor circuit according to a first embodiment of the present invention.

FIG. 2 is a circuit diagram of a transconductor circuit according to the first embodiment. The circuit includes an active element Vccs3 which is serially connected to the active element Vccs1. The Vccs3 inputs a signal voltage Vin+from a control end in3 to generate signal current Iin+, the Iin+ being proportional to the Vin+. The circuit also includes an active element Vccs4 which is serially connected to the active element Vccs2. The Vccs4 inputs a signal voltage Vin− from a control end in4 to generate a signal current Iin−, the Iin− being proportional to the Vin+.

In the circuit shown in FIG. 2, the Iin+ and Iin− which are proportional to the Vin+ and Vin− are obtained on the whole.

Referring again to FIG. 1, the active element (Vccs1, Vccs2) is generally constituted of a single transistor as shown in FIG. 3 to FIG. 6 described later. A parasitic capacity of the transistor constituting the active element (Vccs1, Vccs2) and inverting amplifier circuitry (A1, A2) constitute an integrator. For the integrator, frequency characteristics of the conventional RGC circuit are deteriorated as follows.

Figure 25:
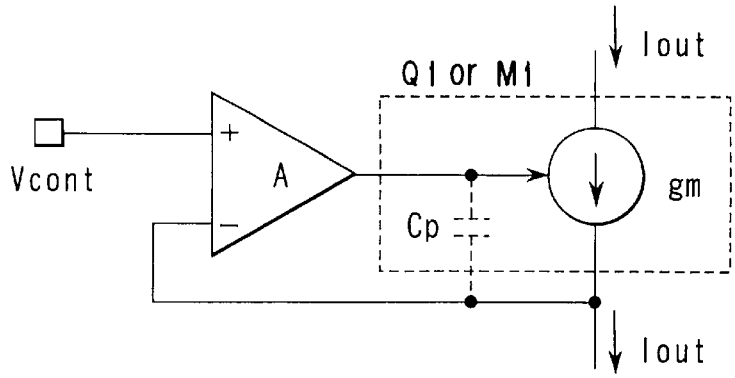
FIG. 25 PRIOR ART
FIG. 25 is an equivalent circuit diagram showing an operation of FIGS. 23 and 24.

Frequency characteristics of a conventional circuit of FIG. 25 are considered. Several capacities parasitic onto the cascode transistor (M1) are considered. Here, only the capacity (CP) between gate and source as the parasitic capacity acting mainly on the frequency characteristics and having the largest value is considered. Moreover, for simplicity, it is assumed that the operational amplifier is an ideal amplifier with a voltage gain (−A), and the output resistance of the transistor (M1) is sufficiently large. A transmission function of the RGC circuit represented by a ratio of a signal current (Iin) flowing through an input terminal to a signal current (Iout) flowing through an output terminal is obtained from Kirchhoff's current law or the like as follows.

$$Iout/Iin=gm/(gm+sCP)\quad s=j2\pi f \tag{1}$$

Here, gm denotes a mutual conductance (output current/input voltage) of the cascode transistor M1. This indicates a characteristic similar to that of a primary low pass filter which cuts off a high frequency. The signal gain which raises the frequency of the signal Iin and is represented by the magnitude of Iout/Iin decays after the frequency represented by gm/(2πCp). Additionally, as the frequency rises, the phase of the signal Iout to Iin starts to lag. The frequency at which the phase starts to lag shifts in response to the frequency gm/(2πCP).

On the other hand, according to the first embodiment, first and second capacity elements (C1, C2) whose capacitances are equal to that of the parasitic capacities are connected between the first output ends (out3, out1) of the active elements (Vccs2, Vccs1) disposed opposite to the control ends (in1, in2) of the active elements (Vccs1, Vccs2).

Then, the current flowing to the control end (in1) of the active element (Vccs1) from the first output end (out1) of the active element (Vccs1) via the parasitic capacity, and the current flowing to the control end (in1) of the active element (Vccs1) from the first input terminal (Iin−) of the impedance conversion circuit via the capacity element (C1) are reverse to each other in polarity, and substantially equal to each other. Therefore, the currents counteract each other. Similarly, the current flowing to the control end (in2) of the active element (Vccs2) from the first output end (out3) of the active element (Vccs2) via the parasitic capacity, and the current flowing to the control end (in2) of the active element (Vccs2) from the first input terminal (Iin+) of the impedance conversion circuit via the capacity element (C2) are reverse to each other in polarity, and substantially equal to each other in size. Therefore, the currents counteract each other.

That is, at several hundreds of megahertz or higher frequencies, in the conventional art which does not include the capacity elements (C1, C2), because of the parasitic capacity Cp, the current neither passed nor amplified through the operational amplifier or the inverting amplifier flow to the control end (in1, in2) of the transistor. There is a problem that high frequency characteristics of the impedance conversion circuit are deteriorated. However, according to the present embodiment, the undesirable current flowing via the parasitic capacity Cp, and the current reverse in polarity and substantially equal in size to the undesirable current are passed to the control ends (in1, in2) of the transistor, and the currents counteract each other. Therefore, the phase of the output current (Iout) of the transistor is prevented from lagging behind the signal current (Iin) inputted to the input terminal (Iin+, Iin−) of the impedance conversion circuit. That is, the frequency characteristics of the impedance conversion circuit can be prevented from being damaged.

A procedure similar to the procedure for obtaining equation (1) is used to obtain the frequency characteristics of the impedance conversion circuit according to the present embodiment as follows.

$$Iout/Iin=(1+A)gm/((1+A)gm+2sCp)\ s=j2\pi f \quad (2)$$

Therefore, the frequency at which the signal gain starts to decay is $(1+A)gm/(4\pi Cp)$. However, when the frequency characteristics of the operational amplifier or the inverting amplifier itself are considered, the constitution becomes further complicated. However, it is assumed here that the operational amplifier or the inverting amplifier have no frequency characteristics and are ideal. Additionally, "A" of "(1+A)gm" in equation (2) denotes the gain of the operational amplifier.

That is, the frequency at which the signal gain starts to decay and the phase starts to lag can be raised to a frequency higher than that of the conventional example by a factor of (1+A)/2. That is, there can be realized an impedance conversion circuit which has less phase lag at higher frequencies as compared with the conventional example.

(Modification Example 1-1)

Figure 3:
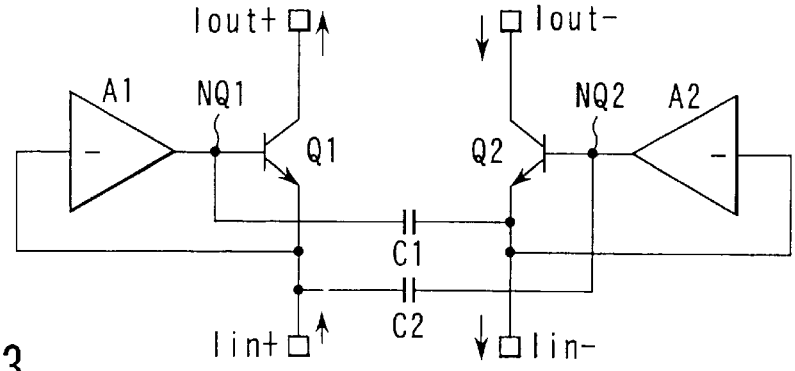
FIG. 3 is a circuit diagram of the impedance conversion circuit according to a modification example 1-1.

FIG. 3 is a circuit diagram of the impedance conversion circuit according to a modification example 1-1. In the example the active element (Vccs1, Vccs2) of FIG. 1 is constituted of a bipolar transistor. Values of capacitors C1 and C2 are preferably set to be substantially equal to the value of the parasitic capacity (mainly the capacity between base and emitter) of the transistor Q1, Q2.

(Modification Example 1-2)

Figure 4:
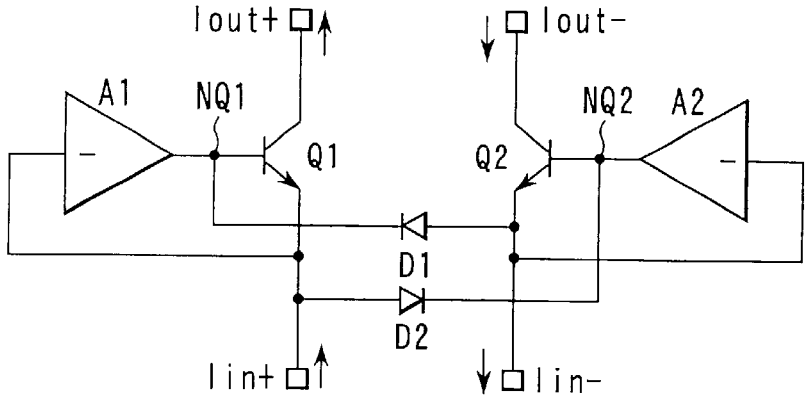
FIG. 4 is a circuit diagram of the impedance conversion circuit according to a modification example 1-2.

FIG. 4 is a circuit diagram of the impedance conversion circuit according to a modification example 1-2. In the example the capacity element (C1, C2) of the impedance conversion circuit shown in FIG. 3 is replaced with a pn junction diode (D1, D2). Even when the capacity of the pn junction diode is utilized instead of the capacity of MIM (Metal Insulator Metal) capacitor using a dielectric, the influence of the parasitic capacity can be reduced. Moreover, the diode is used in FIG. 4, but a diode-connected transistor similar to Q1, Q2 may be used. Furthermore, the capacity may be connected in parallel with D1, D2.

(Modification Example 1-3)

Figure 5:
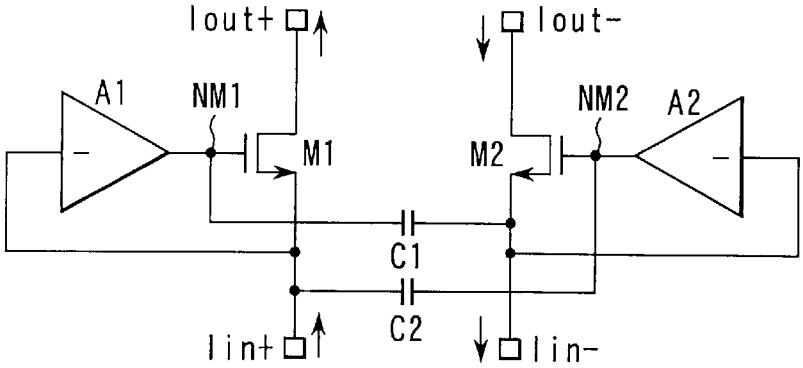
FIG. 5 is a circuit diagram of the impedance conversion circuit according to a modification example 1-3.

FIG. 5 is a circuit diagram of the impedance conversion circuit according to a modification example 1-3. The active element (Vccs1, Vccs2) of FIG. 1 is constituted of a metal insulator semiconductor field-effect transistor (MIS transistor). In the present modification example, a MOS transistor (MOSFET) was used as the MIS transistor. The capacitance of C1 and C2 are preferably set to be substantially equal to the parasitic capacity (mainly a capacity between gate and source) of a transistor M1, M2. Moreover, the MOS transistor (M1, M2) may be disposed in a silicon bulk substrate, or a silicon on insulator (SOI) substrate.

(Modification Example 1-4)

Figure 6:
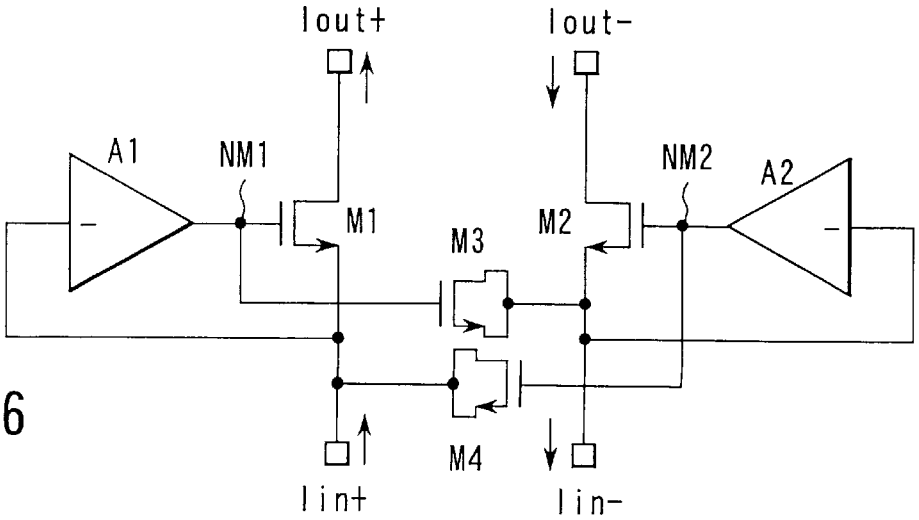
FIG. 6 is a circuit diagram of the impedance conversion circuit according to a modification example 1-4.

FIG. 6 is a circuit diagram of the impedance conversion circuit according to a modification example 1-4. In the present modification example the capacity element (C1, C2) of the impedance conversion circuit shown in FIG. 5 is replaced with the MIS transistor. Even when a drain and source of the MIS transistor having a structure similar to that of M1, M2 are short-circuited and the structure is used instead of (C1, C2), the influence of the gate parasitic capacity can be reduced. Additionally, in the aforementioned "similar structure", a material and thickness of a gate insulating film are substantially the same.

The capacity generated between a gate electrode of the MIS transistor (M3, M4) having a short-circuit between a drain electrode and a source electrode, and a reverse layer channel is about 1.5 times as large as the gate to source capacity operated with the same gate electrode area, under the voltage between the gate electrode and the source electrode, and in a saturation region. Therefore, in order to set the capacity values of M3, M4 to be similar to the capacity value of the parasitic capacity of M1, M2, a ratio of the gate area which influences the parasitic capacity of M3, M4 (gate width×gate length) is preferably designed to be about ⅔ that of the gate area of M1, M2.

According to the present modification example, the parasitic capacities of M1, M2 do not have to be estimated in order to determine the capacitances of C1, C2, and the constitution can easily be designed. Moreover, the parasitic capacity of MIS transistor (M1, M2) also fluctuates with temperature. However, since the transistors having the similar structure are used in M3, M4, the influence of the parasitic capacity fluctuation caused by a temperature fluctuation, element dispersion, and the like is hardly exerted.

Figure 7:
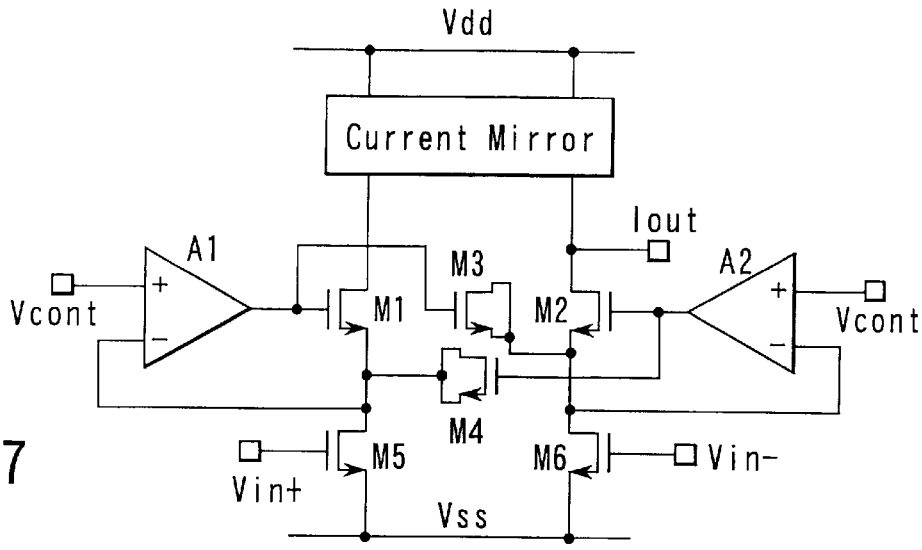
FIG. 7 is a circuit diagram of a first transconductor to which the impedance conversion circuit of FIG. 6 is applied.
Figure 26:
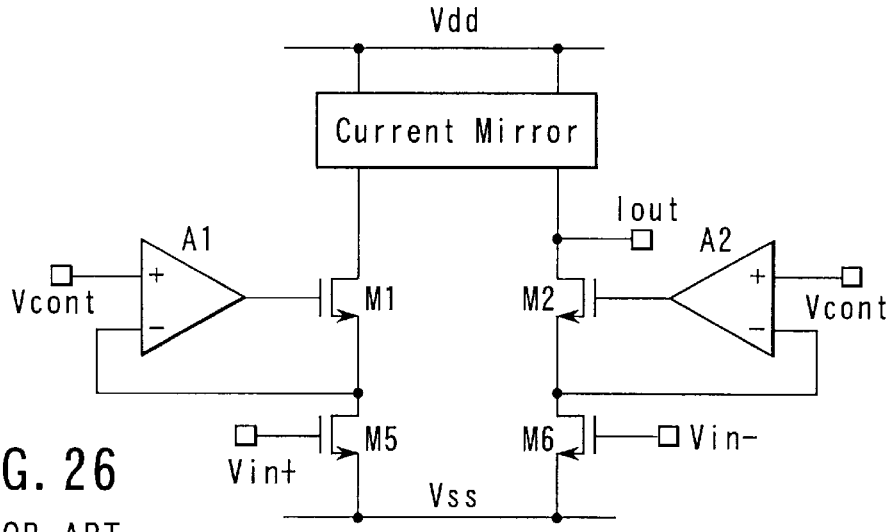
FIG. 26 PRIOR ART
FIG. 26 is a circuit diagram of the transconductor to which the conventional impedance conversion circuit is applied.

FIG. 7 is a circuit diagram of a first transconductor to which the impedance conversion circuit of FIG. 6 is applied. In the diagram, Vin+ and Vin− correspond to differential voltage input terminals of the first transconductor. When differential signals are inputted via Vin+ and Vin−, signal currents Id having phases reverse to each other flow through drains of MS, M6. The drain current Id flowing through M5 flows through the transistor M1 of the RGC circuit as it is, and is copied via a current mirror on an output terminal Iout side. Moreover, a drain current Id' of M6 flowing via M2 also flows toward the output terminal Iout, and a difference current (Id−Id') of the drain currents of M5 and M6 can be extracted from the output terminal. The transconductor ideally has a high input resistance and high output resistance. The output resistance of the RGC circuit can secure a very large value as compared with that of a cascode amplifier in which a sub-amplifier is not used. Therefore, when the output resistance of a current mirror circuit is sufficiently large, the high output resistance can be secured. FIG. 26 shows the transconductor to which conventional impedance conversion circuit applied.

Figure 9:
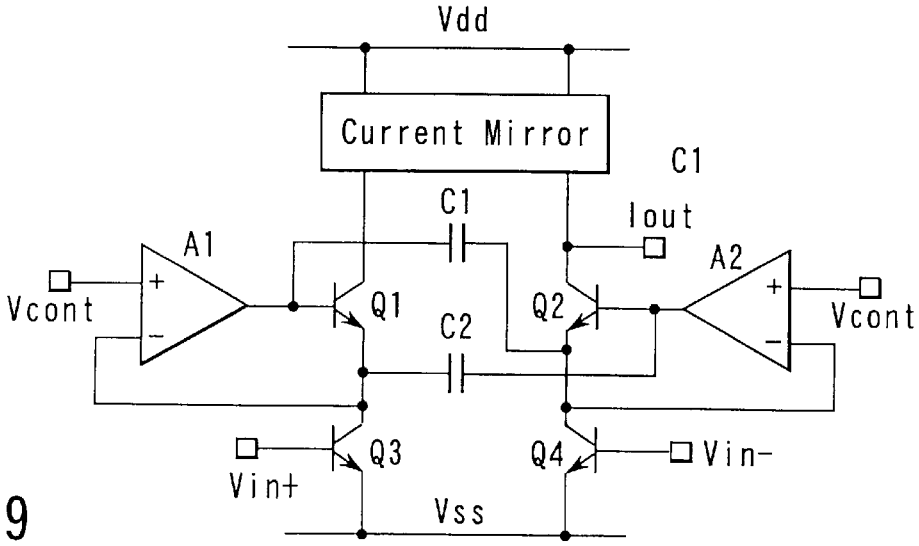
FIG. 9 is a circuit diagram of a second transconductor to which the impedance conversion circuit of FIG. 3 is applied.

FIG. 9 is a circuit diagram of an alternative of the first transconductor shown in FIG. 7. The transconductor shown in FIG. 9 includes bipolar transistors (Q1, Q2, Q3, Q4) as a substitute for the MIS transistors (M1, M2, M5, M6) and includes capacity elements (C1, C2) as a substitute for the MIS transistors (M3, M4) which are provided for the suppression of unnecessary currents.

Figure 8:
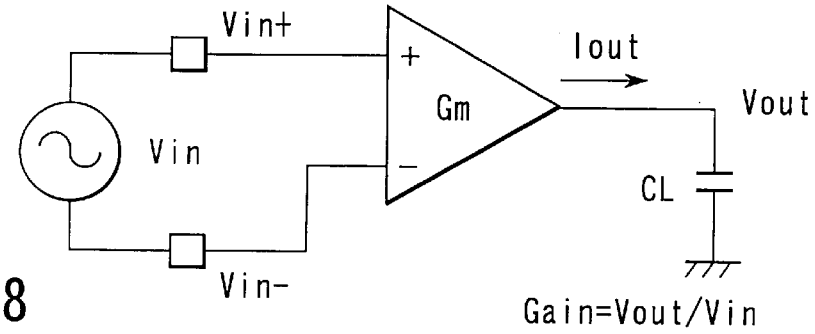
FIG. 8 is a circuit diagram of an integrator constituted by connecting an output capacity (CL) to an output terminal Iout of a circuit of FIG. 7 or FIG. 26 with respect to ground (Vss)

FIG. 8 is a circuit diagram of an integrator constituted by connecting an output capacity (CL) to an output terminal Iout of a circuit of FIG. 7 or FIG. 26 with respect to a ground (Vss).

Figure 10A:
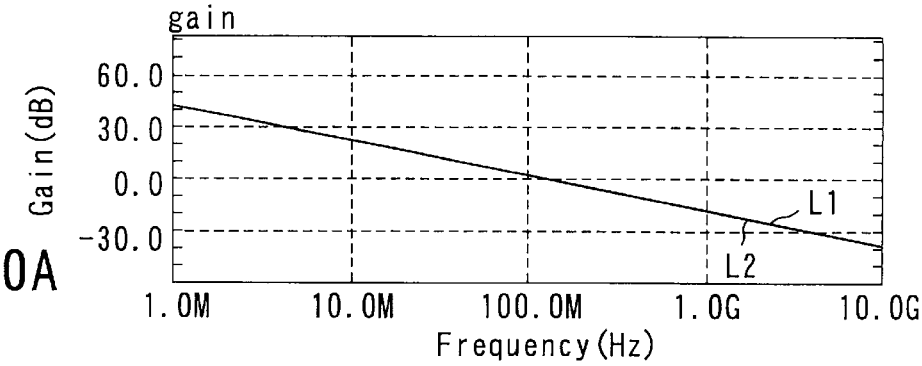
FIG. 10A is Bode plot of a simulation result for the integrator shown in FIG. 8.
Figure 10B:
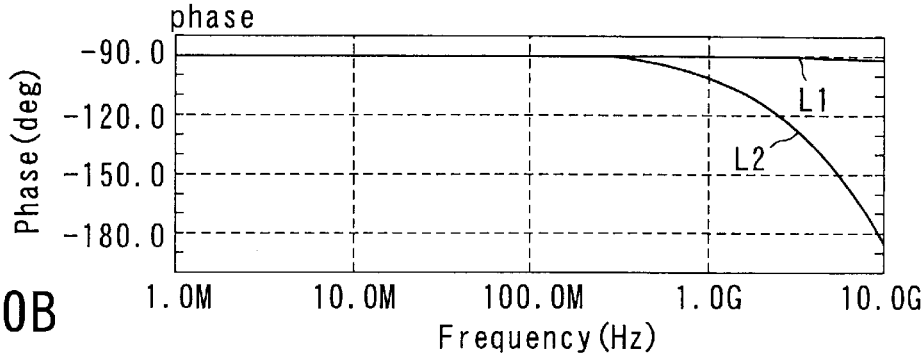
FIG. 10B is Bode plot of another simulation result for the integrator shown in FIG. 8.

FIGS. 10A and 10B are Bode plots of simulation results for the integrator shown in FIG. 8. For the Bode plots, the signal voltage is inputted via terminals Vin+ and Vin− in a differential manner, and the frequency characteristics of the terminal voltage of the output terminal Iout are checked. Ideally, the gain linearly decreases by −20 dB/dec. ("/dec." is "per decade"; this means "per ten times the abscissa") over a broad frequency, and the phase is preferably kept at −90 degrees. With the integrator, a standard of the phase lag is −90 degrees. As seen only from a gain characteristic diagram of FIG. 10A, the characteristic Li of the circuit (FIG. 7) of the present embodiment is hardly different from the characteristic L2 of the conventional circuit (FIG. 26). However, in comparison with a phase characteristic diagram of FIG. 10B, it is seen that the phase largely lags beyond 100

MHz in the characteristic L2 of the circuit (FIG. 26). In the characteristic L2, the phase exceeds −100 degrees before 1 GHz. On the other hand, in the characteristic L1 of the present embodiment (FIG. 7) the phase moderately shifts, and is about −93 degrees even at 10 GHz. More specifically, in characteristic L2 (FIG. 26) the frequency at which the phase lags from −90 degrees by 1% is 75 MHz. On the other hand, in the characteristic L1 of the present embodiment (FIG. 7), the frequency is improved up to 1.95 GHz.

Additionally, in the present simulation, with an operational amplifier voltage gain A of 500 times, transistor M1, M2 gate with a width of 100 μm and length of 0.5 μm, and gate oxide film thickness of 15 μm, the parasitic capacity between gate and source was set to about 200 fF.

Figure 11:
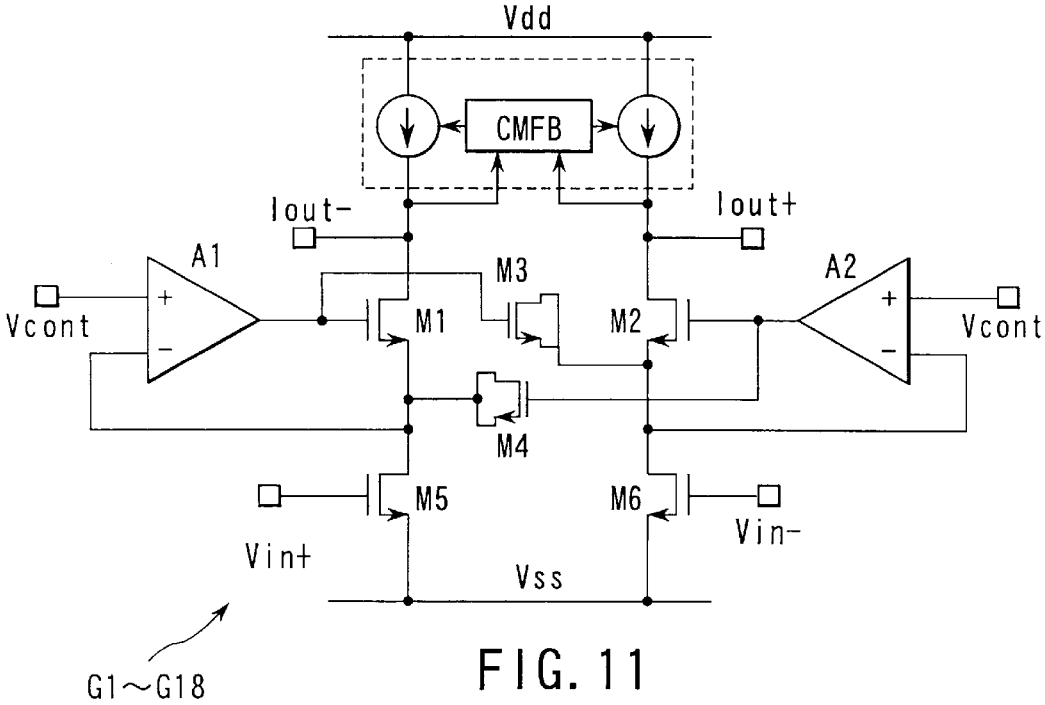
FIG. 11 is a circuit diagram of a third transconductor in which the impedance conversion circuit of FIG. 6 is used.
Figure 27:
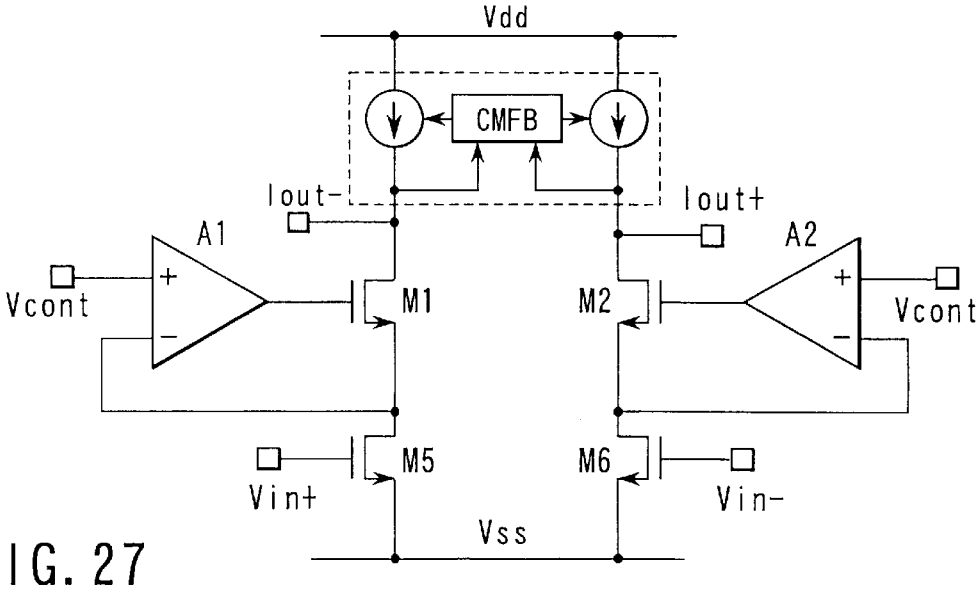
FIG. 27 PRIOR ART
FIG. 27 is a circuit diagram of the anther conventional transconductor.

FIG. 11 is a circuit diagram of a second transconductor to which the impedance conversion circuit of FIG. 6 is applied. The transconductor is different from the first transconductor of FIG. 7, in that a constant current source is connected instead of the current mirror and the output is extracted as it is in a differential manner. In FIG. 11 CMFB denotes a common mode feedback circuit. In the circuit, a voltage average of two output terminals is detected, and a current value of the current source is adjusted in such a manner that an operation point voltage of the transconductor output terminal is a predetermined operation point voltage. FIG. 27 is a circuit diagram of the conventional transconductor, wherein the conventional impedance conversion circuit is applied to the second (CMFB type) transconductor shown in FIG. 11.

Figure 12:
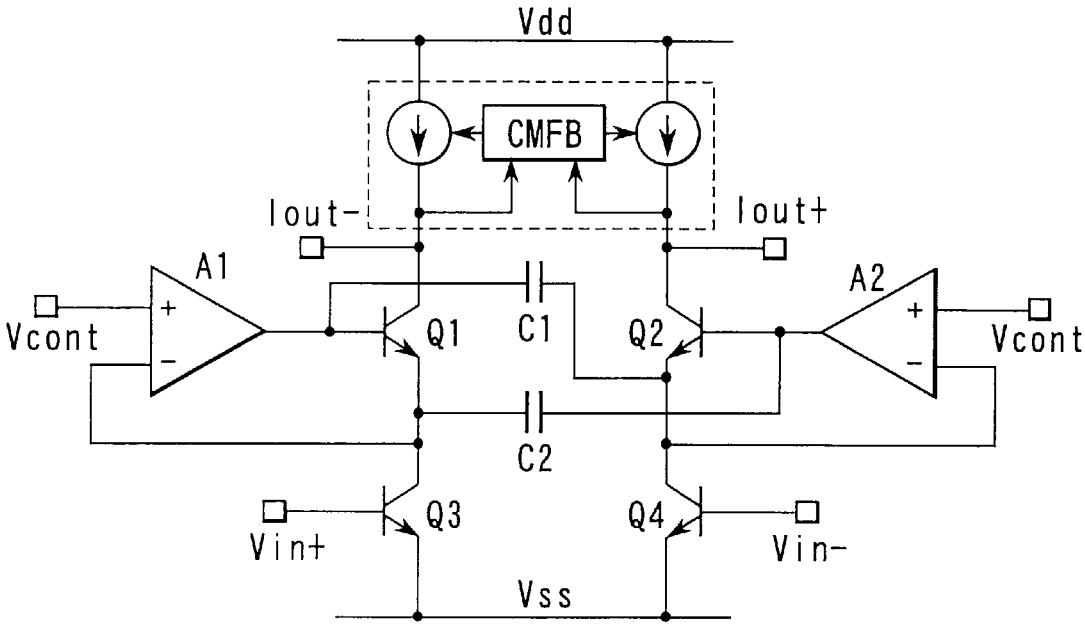
FIG. 12 is a circuit diagram of an alternative of the third transconductor shown in FIG. 11, which is constituted by MOS transistors and capacitors.

FIG. 12 is a circuit diagram of an alternative of the second transconductor shown in FIG. 11. The alternative includes bipolar transistors (Q1, Q2, Q3, Q4) as a substitute for the MIS transistors (M1, M2, M5, M6) and includes capacity elements (C1, C2) as a substitute for the MIS transistors (M3, M4) which are provided for the suppression of unnecessary currents.

Figure 13:
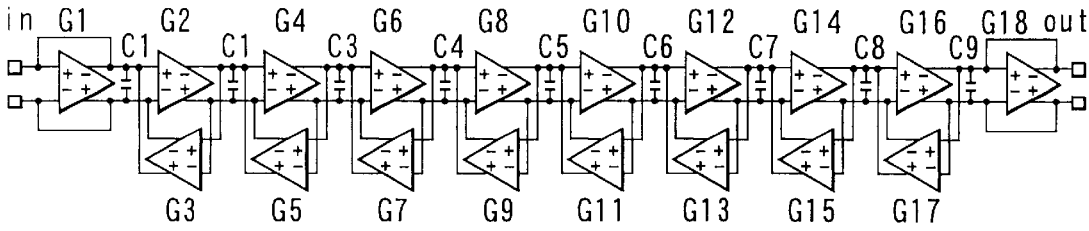
FIG. 13 is a circuit diagram of a ninth-order low pass filter using the third transconductor shown in FIG. 11.

FIG. 13 is a circuit diagram of a ninth-order low pass filter (Chebyshev with a ripple of 0.01 dB) constituted by the second transconductor of FIG. 11 or FIG. 12. In the diagram, each of G1 to G18 corresponds to the second transconductor shown in FIG. 11 or FIG. 12. The signal currents having the same amplitude and reverse phases flow in each output of the transconductor. A method of determining a transconductance value and other basic operations are the same as those of FIG. 7. It should be noted that the order of the low pass filter is not limited to the ninth.

Figure 14:
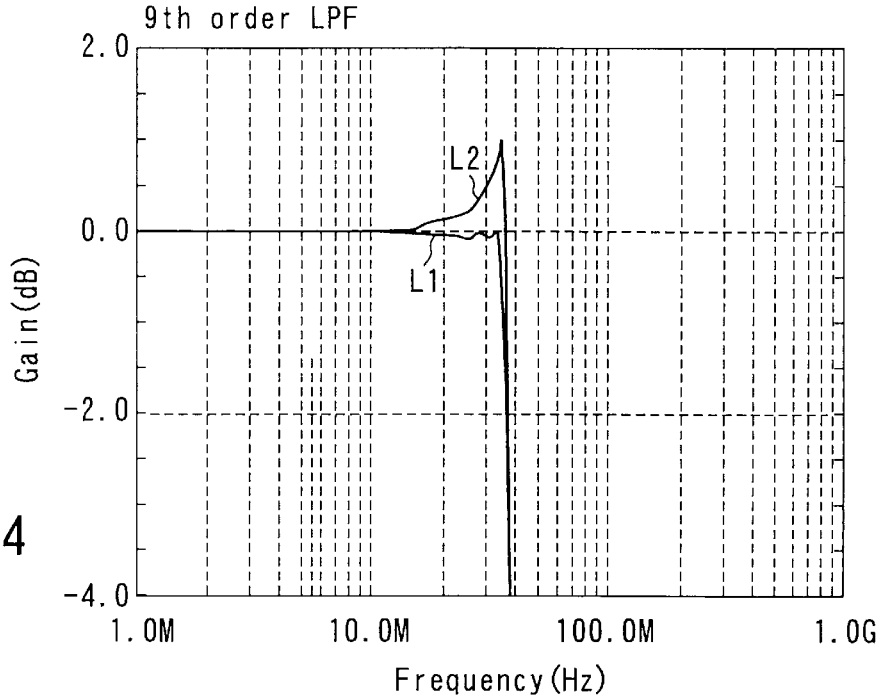
FIG. 14 is a graph in which frequency and gain characteristics in FIG. 13 are compared.

FIG. 14 is a graph in which frequency and gain characteristics of the ninth-order low pass filter shown in FIG. 13 are compared. In FIG. 14, the use of the second transconductor shown in FIG. 11 is shown by any the characteristic L1, and the use of the conventional transconductor shown in FIG. 27 is shown by the characteristic L2. Note that the conventional transconductor shown in FIG. 27 has the arrangement of excluding M3, M4 of FIG. 11. As can be seen from the characteristic L2, a peak close to 1 dB is shown in the vicinity of a cut-off frequency. The peak in the vicinity of the cut-off frequency is undesirable, because signal strain is increased and further filter group lag characteristics are deteriorated. On the other hand, according to the characteristic L1, a pass band is flat (ripple of 0.1 dB or less within the band). It is seen that an effect of the first embodiment appears.

Figure 15:
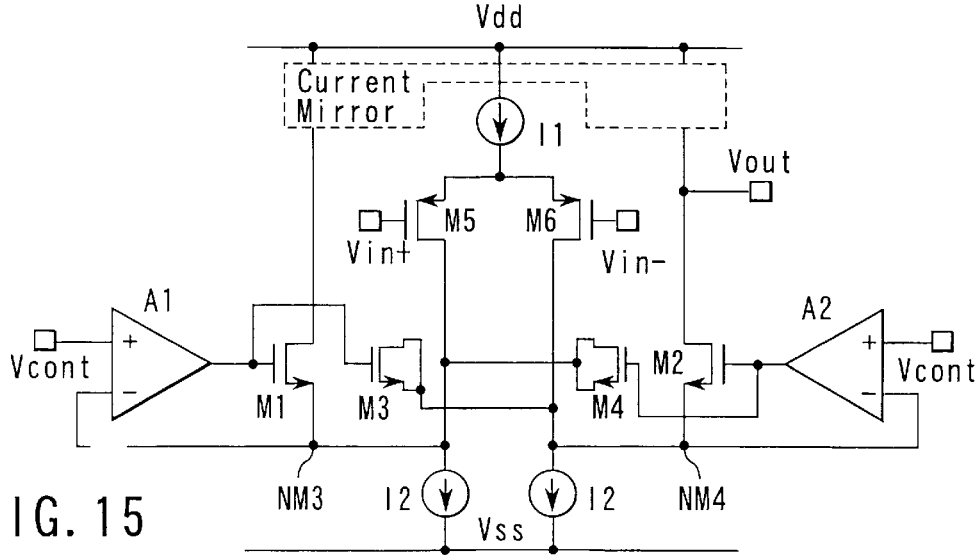
FIG. 15 is a circuit diagram of an operational amplifier using the impedance conversion circuit of FIG. 6.

FIG. 15 is a circuit diagram of an operational amplifier. The impedance conversion circuit described with reference to FIG. 6 is applied to the operational amplifier having a folded cascode constitution with one gain stage. Here, the impedance conversion circuit constituted by the MOS transistor is shown, but the bipolar transistor can similarly be applied. When the operational amplifier having a large gain is realized, it is preferable to obtain an output impedance of the gain stage (differential pair of common sources of M5, M6 in FIG. 15) as high as possible. Therefore, the gain-stage output (NM3, NM4 of FIG. 15) is connected to an output terminal Vout via the impedance conversion circuit. Here, in order to broaden a common operation voltage range of the transistor of an input gain stage, instead of using a tandem constitution as shown in FIG. 7, a constitution in which an input-stage drain side is folded via the constant current source is employed.

Figure 16A:
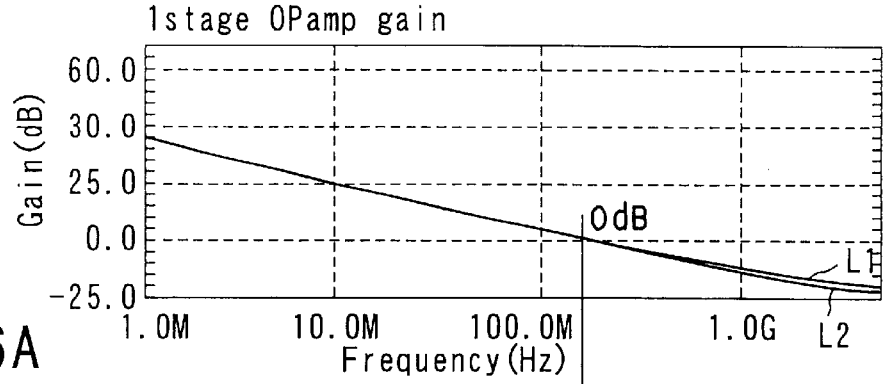
FIG. 16A is Bode plot showing results of the gain characteristic of the operational amplifier of FIG. 15.
Figure 16B:
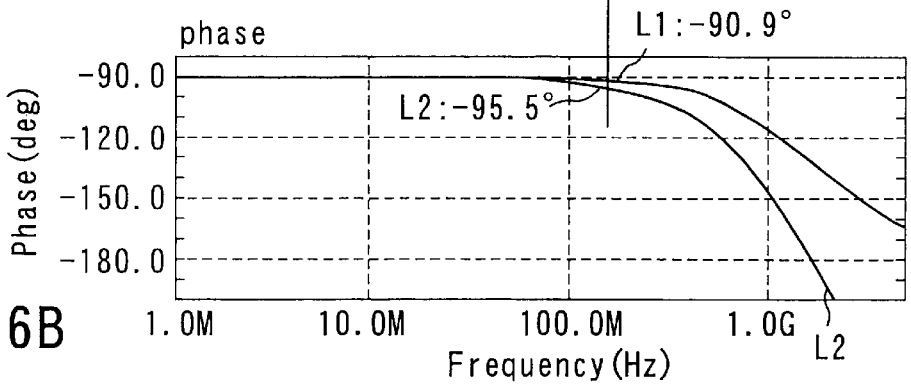
FIG. 16B is Bode plot showing results of the phase characteristic of the operational amplifier of FIG. 15.

FIGS. 16A and 16B are characteristic diagrams showing results of the gain and phase characteristics of the operational amplifier of FIG. 15. The characteristic L1 shows an example of the operational amplifier of FIG. 15. The characteristic L2 shows a conventional example excluding M3, M4 of the operational amplifier of FIG. 15. As shown in FIG. 16A, a frequency at which the gain is 0 dB is substantially the same. In this case, as seen from FIG. 16B, the phase lags from −90 degrees by 5.5 degrees in the characteristic L2, while the lag is about 0.9 degree, that is, within 1% in the characteristic L1. That is, this result shows that the present embodiment is more advantageous in regard to stability during operation using feedback.

(Second Embodiment)

Figure 17:
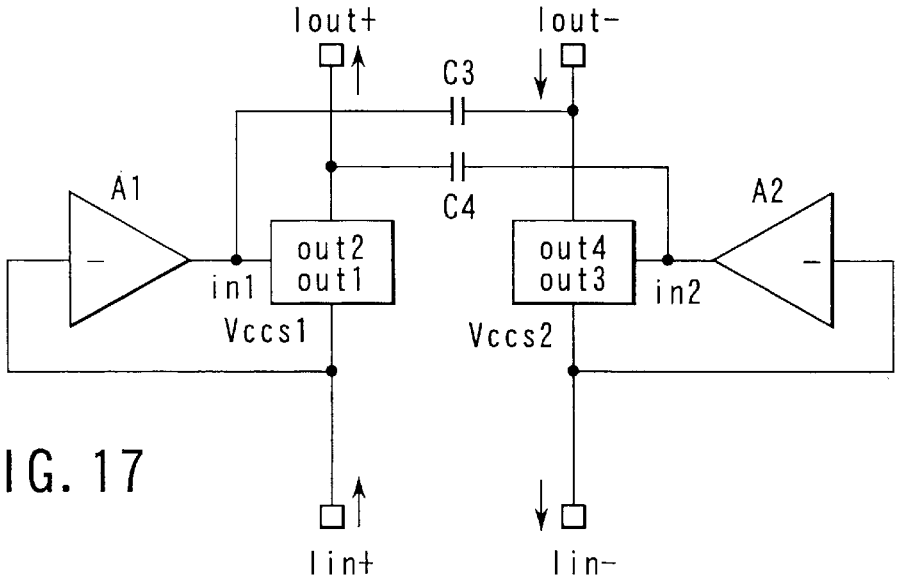
FIG. 17 is a circuit diagram of the impedance conversion circuit according to a second embodiment of the present invention.

FIG. 17 is a circuit diagram of the impedance conversion circuit according to a second embodiment of the present invention. Since an operation of the circuit excluding the capacity element (C3, C4) is the same as the operation of the first embodiment described with reference to FIG. 1, a description thereof is omitted. FIG. 17 is different from FIG. 1, in that the capacity element (C3, C4) is connected on a second output terminal (out2, out4) side of the active element (Vccs1, Vccs2). In the first embodiment, the influence of the parasitic capacity present between the input terminal (in1, in2) and the output terminal (out1, out3) of the active element (Vccs1, Vccs2) is counteracted. However, the influence of the parasitic capacity (i.e., the capacity between base and collector or the capacity between gate and drain) present between the input terminal (in1, in2) and the output terminal (out2, out4) of the active element (Vccs1, Vccs2) cannot be counteracted in the first embodiment. The parasitic capacity still deteriorates the frequency characteristics, because the integrator for applying a feedback to input/output of the active element (Vccs1, Vccs2) is constituted. According to the second embodiment, similarly as the first embodiment, the influence of the parasitic capacity present between the input terminal (in1, in2) and the output terminal out2, out4 of the active element (Vccs1, Vccs2) can be counteracted. Additionally, with the field-effect transistor, the capacity between gate and drain is about 1/10 of the capacity between gate and source.

(Modification Example 2-1)

Figure 18:
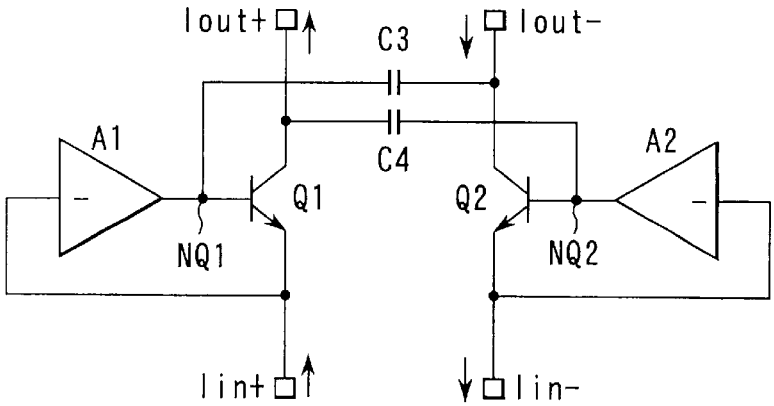
FIG. 18 is a circuit diagram of the impedance conversion circuit according to a modification example 2-1 of FIG. 17.

FIG. 18 is a circuit diagram of the impedance conversion circuit according to a modification example 2-1. In the example, the active element (Vccs1, Vccs2) of FIG. 17 is constituted of the bipolar transistor. The values of the capacitors C3 and C4 are preferably set to be substantially equal to the value of the parasitic capacity (mainly the capacity between base and collector) of the transistor Q1, Q2.

(Modification Example 2-2)

Figure 19:
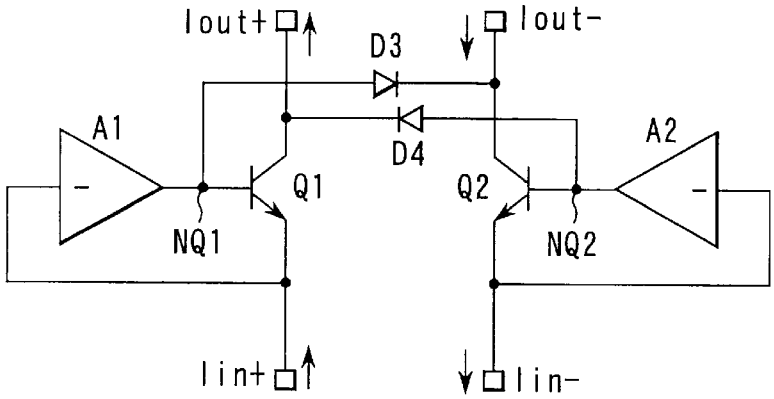
FIG. 19 is a circuit diagram of the impedance conversion circuit according to a modification example 2-2 of FIG. 17.

FIG. 19 is a circuit diagram of the impedance conversion circuit according to a modification example 2-2. In the example, the capacity element (C3, C4) is replaced with a pn junction diode (D3, D4) in the impedance conversion circuit shown in FIG. 18.

(Modification Example 2-3)

Figure 20:
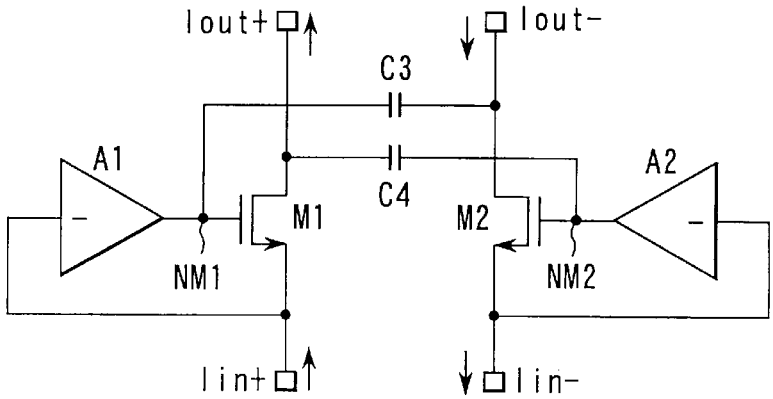
FIG. 20 is a circuit diagram of the impedance conversion circuit according to a modification example 2-3 of FIG. 17.

FIG. 20 is a circuit diagram of the impedance conversion circuit according to a modification example 2-3. The active element (Vccs1, Vccs2) of FIG. 17 is constituted of the metal insulator semiconductor field-effect transistor (MIS transistor). In the present modification example, the MOS transistor (MOSFET) was used as the MIS transistor. The values of C3 and C4 are preferably set to be substantially equal to the value of the parasitic capacity (mainly the capacity between gate and drain) of the transistor M1, M2.

(Modification Example 2-4)

Figure 21:
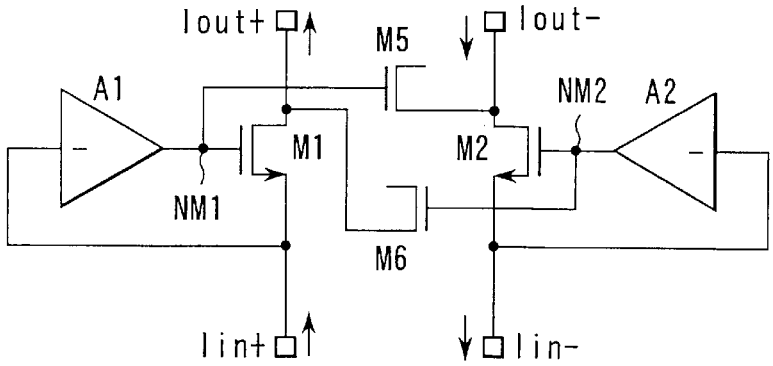
FIG. 21 is a circuit diagram of the impedance conversion circuit according to a modification example 2-4 of FIG. 17.

FIG. 21 is a circuit diagram of the impedance conversion circuit according to a modification example 2-4. The capacity element (C3, C4) is further replaced with the MIS transistor in the impedance conversion circuit shown in FIG. 20. Even when the MIS transistor (MS, M6) having the structure similar to the structure of M1, M2 and disconnecting either the drain or the source is used instead of C3, C4, the influence of the gate parasitic capacity can be reduced. Additionally, in the aforementioned "similar structure", the material and thickness of the gate insulating film are substantially the same.

(Modification Example 2-5)

Figure 22:
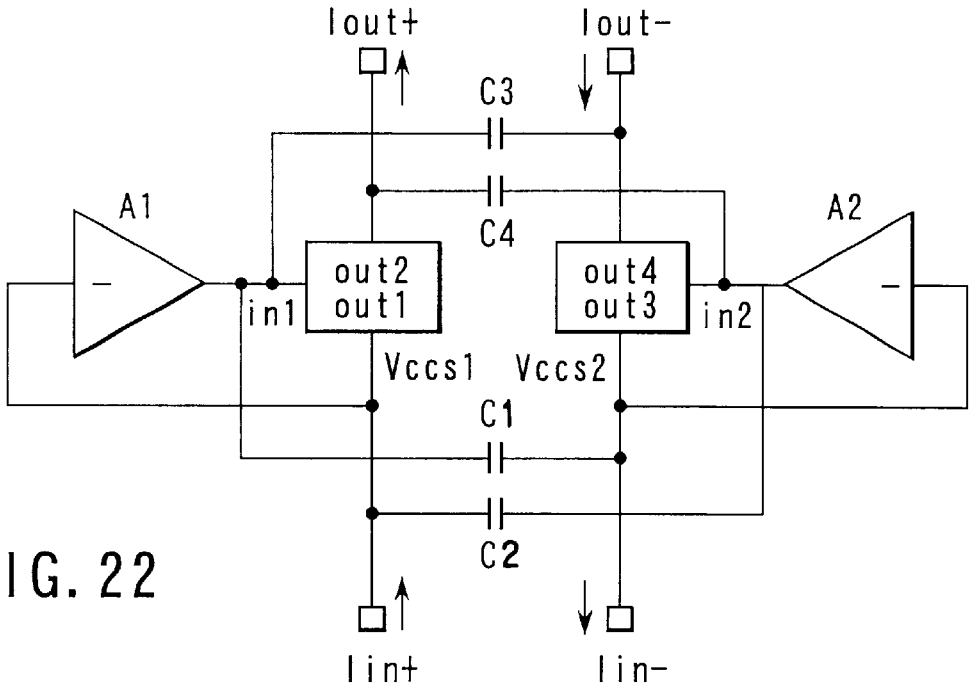
FIG. 22 is a circuit diagram of the impedance conversion circuit according to a modification example 2-5 of FIG. 17.
Figure 23:
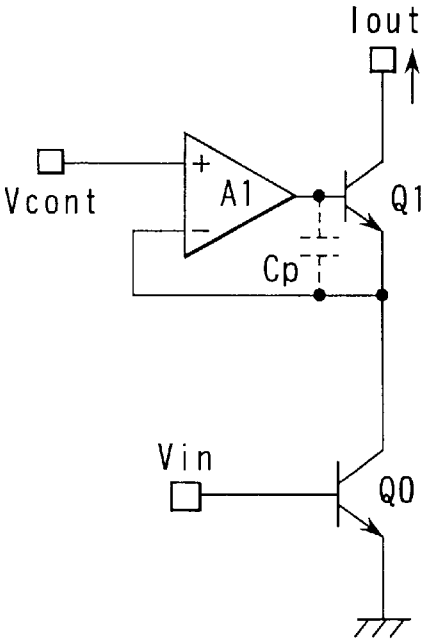
FIG. 23 PRIOR ART
FIG. 23 is a circuit diagram of a conventional regulated cascode circuit (RGC circuit)
Figure 24:
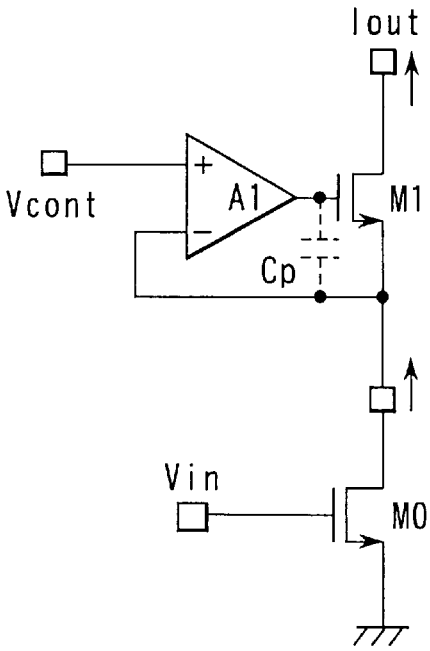
FIG. 24 PRIOR ART
FIG. 24 is a circuit diagram of another conventional RGC circuit.

FIG. 22 is a circuit diagram of the impedance conversion circuit according to a modification example 2-5. The capacity element (C1, C2) described with reference to FIG. 1 is added to the impedance conversion circuit shown in FIG. 17. According to the present modification example, the parasitic capacity accompanying the active element (Vccs1, Vccs2), which raises a problem in the first and second embodiments, can be counteracted, and further improvement effect of the frequency characteristics of the impedance conversion circuit can be expected.

(Other Embodiments)

The first and second embodiments and modification examples of the present invention have been described, but the present invention is not limited to the above description. For example, the transistors M5, M6 of FIG. 21 may be replaced with the transistors M3, M4 of FIG. 7. The capacity elements (C1 to C4) may be variable capacitors instead of fixed capacitors.

As described above, according to the present invention, there can be provided an impedance conversion circuit in which satisfactory frequency characteristics can be maintained even at higher frequencies.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An impedance conversion circuit comprising:

a first current input terminal to which a first signal current is input;

a first transistor having a base, collector, and emitter, the emitter being connected to the first current input terminal;

a first amplifier circuitry connected between the emitter and the base of the first transistor;

a second current input terminal to which a second signal current having a phase opposite to a phase of the first signal current is input;

a second transistor having a base, collector, and emitter, the emitter being connected to the second current input terminal;

a second amplifier circuitry connected between the emitter and the base of the second transistor;

a first capacitive element connected between the base of the first transistor and the emitter of the second transistor; and a second capacitive element connected between the base of the second transistor and the emitter of the first transistor.

2. An impedance conversion circuit of claim 1, wherein said first capacitive element includes a first capacitor and said second capacitive element includes a second capacitor.

3. An impedance conversion circuit of claim 1, wherein said first capacitive element includes a first active element and said second capacitive element includes a second active element.

4. An impedance conversion circuit of claim 1, wherein said first capacitive element includes a first diode and said second capacitive element includes a second diode.

5. An impedance conversion circuit of claim 1, wherein said first amplifier circuitry is a first operational amplifier having an inversion input terminal which is connected to said emitter of said first transistor and said second amplifier circuitry includes a second operational amplifier having an inversion input terminal which is connected to said emitter of said second transistor.

6. An impedance conversion circuit of claim 1, wherein said first and second amplifier circuitries include an inverting amplifier configured to invert output signals from the emitters of the first and second transistors, amplify inverted signals, and apply amplified signals to the bases of the first and second transistors.

7. A transconductor circuit comprising:

a first voltage input terminal to which a first signal voltage is input;

a first current source connected to the first voltage input terminal, configured to generate a first signal current in proportion to the first signal voltage;

a first transistor having a base, collector, and emitter, the emitter being connected to the first current source;

a first amplifier circuitry connected between the emitter and the base of the first transistor;

a second voltage input terminal to which a second signal voltage having a negative phase of the first signal voltage is input;

a second current source connected to the second voltage input terminal, configured to generate a second signal current in proportion to the second signal voltage;

a second transistor having a base, collector, and emitter, the emitter being connected to the second current source;

a second amplifier circuitry connected between the emitter and the base of the second transistor;

a first capacitive element connected between the base of the first transistor and the emitter of the second transistor; and a second capacitive element connected between the base of the second transistor and the emitter of the first transistor.

8. A transconductor circuit of claim 7, further comprising:

a current-mirror circuitry connected to said collectors of said first and second transistors.

9. A transconductor circuit of claim 7, further comprising a load circuitry including:

a third current source connected to said collector of said first transistor;

a fourth current source connected to said collector of said second transistor; and a common-mode feed-back circuitry configured to commonly bias the third and fourth current sources.

10. An impedance conversion circuit comprising:

a first current input terminal to which a first signal current is input;

a first transistor having a gate, drain, and source, the source being connected to the first current input terminal;

a first amplifier circuitry connected between the source and the gate of the first transistor;

a second current input terminal to which a second signal current having a phase opposite to a phase of the first signal current is input;

a second transistor having a gate, drain, and source, the source being connected to the second current input terminal;

a second amplifier circuitry connected between the source and the gate of the second transistor;

a first capacitive element connected between the gate of the first transistor and the source of the second transistor; and a second capacitive element connected between the gate of the second transistor and the source of the first transistor.

11. An impedance conversion circuit of claim 10, wherein said first capacitive element includes a first capacitor and said second capacitive element includes a second capacitor.

12. An impedance conversion circuit of claim 10, wherein said first capacitive element includes a first active element and said second capacitive element includes a second active element.

13. An impedance conversion circuit of claim 10, wherein said first capacitive element includes a first diode and said second capacitive element includes a second diode.

14. An impedance conversion circuit of claim 10, wherein said first amplifier circuitry is a first operational amplifier having an inversion input terminal which is connected to said source of said first transistor and said second amplifier circuitry is a second operational amplifier having an inversion input terminal which is connected to said source of said second transistor.

15. An impedance conversion circuit of claim 10, wherein said first and second amplifier circuitries include an inverting amplifier configured to invert output signals from the sources of the first and second transistors, amplify inverted signals, and apply amplified signals to the gates of the first and second transistors.

16. A transconductor circuit comprising:

a first voltage input terminal to which a first signal voltage is input;

a first current source connected to the first voltage input terminal, configured to generate a first signal current in proportion to the first signal voltage;

a first transistor having a gate, drain, and source, the source being connected to the first current source;

a first amplifier circuitry connected between the source and the gate of the first transistor;

a second voltage input terminal to which a second signal voltage having a negative phase of the first signal voltage is input;

a second current source connected to the second voltage input terminal, configured to generate a second signal current in proportion to the second signal voltage;

a second transistor having a gate, drain, and source, the source being connected to the second current source;

a first amplifier circuitry connected between the source and the gate of the second transistor;

a first capacitive element connected between the gate of the first transistor and the source of the second transistor; and a second capacitive element connected between the gate of the second transistor and the source of the first transistor.

17. A transconductor circuit of claim 16, further comprising:

a current-mirror circuitry connected to said drains of said first and second transistors.

18. A transconductor circuit of claim 16, further comprising a load circuitry including:

a third current source connected to said drain of said first transistor;

a fourth current source connected to said drain of said second transistor; and a common-mode feed-back circuitry configured to commonly bias the third and fourth current sources.

19. An impedance conversion circuit comprising:

a first current input terminal to which a first signal current is input;

a first transistor having a base, collector, and emitter, the emitter being connected to the first current input terminal;

a first amplifier circuitry connected between the emitter and the base of the first transistor;

a second current input terminal to which a second signal current having a phase opposite to a phase of the first signal current is input;

a second transistor having a base, collector, and emitter, the emitter being connected to the second current input terminal;

a second amplifier circuitry connected between the emitter and the base of the second transistor;

a third capacitive element connected between the base of the first transistor and the collector of the second transistor; and a fourth capacitive element connected between the base of the second transistor and the collector of the first transistor.

20. An impedance conversion circuit comprising:

a first current input terminal to which a first signal current is input;

a first transistor having a gate, drain, and source, the source being connected to the first current input terminal;

a first amplifier circuitry connected between the source and the gate of the first transistor;

a second current input terminal to which a second signal current having a phase opposite to a phase of the first signal current is input;

a second transistor having a gate, drain, and source, the source being connected to the second current input terminal;

a second amplifier circuitry connected between the source and the gate of the second transistor;

a third capacitive element connected between the gate of the first transistor and the drain of the second transistor; and a fourth capacitive element connected between the gate of the second transistor and the drain of the first transistor.

21. An impedance conversion circuit comprising:

a first current input terminal to which a first signal current is input;

a first transistor having a base, collector, and emitter, the emitter being connected to the first current input terminal;

a first amplifier circuitry connected between the emitter and the base of the first transistor;

a second current input terminal to which a second signal current having a phase opposite to a phase of the first signal current is input;

a second transistor having a base, collector, and emitter, the emitter being connected to the second current input terminal;

a second amplifier circuitry connected between the emitter and the base of the second transistor;

a first capacitive element connected between the base of the first transistor and the emitter of the second transistor;

a second capacitive element connected between the base of the second transistor and the emitter of the first transistor;

a third capacitive element connected between the base of the first transistor and the collector of the second transistor; and a fourth capacitive element connected between the base of the second transistor and the collector of the first transistor.

22. An impedance conversion circuit comprising:

a first current input terminal to which a first signal current is input;

a first transistor having a gate, drain, and source, the source being connected to the first current input terminal;

a first amplifier circuitry connected between the source and the gate of the first transistor;

a second current input terminal to which a second signal current having a phase opposite to a phase of the first signal current is input;

a second transistor having a gate, drain, and source, the source being connected to the second current input terminal;

a second amplifier circuitry connected between the source and the gate of the second transistor;

a first capacitive element connected between the gate of the first transistor and the source of the second transistor;

a second capacitive element connected between the gate of the second transistor and the source of the first transistor;

a third capacitive element connected between the gate of the first transistor and the drain of the second transistor; and a fourth capacitive element connected between the gate of the second transistor and the drain of the first transistor.

* * * * *